US011300898B2

(12) United States Patent
Wang et al.

(10) Patent No.: US 11,300,898 B2
(45) Date of Patent: Apr. 12, 2022

(54) DEVELOPING CARTRIDGE INCLUDING BLADE AND BLADE HOLDER FOR SUPPORTING END PORTION OF BLADE

(71) Applicant: BROTHER KOGYO KABUSHIKI KAISHA, Nagoya (JP)

(72) Inventors: Yuwen Wang, Nagoya (JP); Junichi Hashimoto, Toyohashi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/951,122

(22) Filed: Nov. 18, 2020

(65) Prior Publication Data

US 2021/0072664 A1 Mar. 11, 2021

Related U.S. Application Data

(63) Continuation of application No. 16/458,340, filed on Jul. 1, 2019, now Pat. No. 10,845,728.

(30) Foreign Application Priority Data

Sep. 28, 2018 (JP) ..... JP2018-183058

(51) Int. Cl.
*G03G 15/08* (2006.01)

(52) U.S. Cl.
CPC ..... *G03G 15/0812* (2013.01); *G03G 15/0865* (2013.01)

(58) Field of Classification Search
CPC ..... G03G 15/0812; G03G 15/0865; G03G 21/181
See application file for complete search history.

(56) References Cited

U.S. PATENT DOCUMENTS 6,021,298 A 2/2000 Liu et al.
2002/0003974 A1 1/2002 Nittani et al.
(Continued)

FOREIGN PATENT DOCUMENTS

JP 11-282250 A 10/1999
JP 3362541 B2 10/2002
(Continued)

OTHER PUBLICATIONS

International Search Report and Written Opinion issued in related International Patent Application No. PCT/JP2019/026053, dated Sep. 24, 2019.
(Continued)

*Primary Examiner* — Hoang X Ngo
(74) *Attorney, Agent, or Firm* — Merchant & Gould P.C.

(57) ABSTRACT

A developing cartridge includes: a casing having a groove recessed inward; a developing roller having an outer circumferential surface; a blade; and a blade holder having a first plate and a second plate. The developing roller is rotatable about a rotational axis extending in a first direction. The blade regulates a thickness of toner layer on the outer circumferential surface. The blade has one end portion and another end portion in a second direction. The another end portion of the blade is positioned farther from the outer circumferential surface than the one end portion of the blade is from the outer circumferential surface. The first plate extends in the second direction and supports the another end portion of the blade. The second plate extends from the first plate in a third direction crossing the second direction to have a distal end portion positioned within the groove.

17 Claims, 5 Drawing Sheets

(56) References Cited

U.S. PATENT DOCUMENTS

| | | | | |
|---|---|---|---|---|
| 2004/0091290 | A1 | 5/2004 | Yamada et al. | |
| 2008/0145093 | A1* | 6/2008 | Fukuta | G03G 15/0898 399/103 |
| 2010/0189472 | A1 | 7/2010 | Mori et al. | |
| 2011/0158708 | A1 | 6/2011 | Mori | |
| 2012/0082477 | A1 | 4/2012 | Ito | |
| 2012/0269545 | A1 | 10/2012 | Morita et al. | |
| 2013/0028640 | A1 | 1/2013 | Sato et al. | |
| 2014/0153959 | A1 | 6/2014 | Handa et al. | |
| 2014/0153962 | A1* | 6/2014 | Handa | G03G 15/0817 399/103 |
| 2017/0115603 | A1 | 4/2017 | Mori | |
| 2018/0046136 | A1 | 2/2018 | Suzuki et al. | |

FOREIGN PATENT DOCUMENTS

| | | | |
|---|---|---|---|
| JP | 2007-233070 | A | 9/2007 |
| JP | 2012-078380 | A | 4/2012 |
| JP | 2012-230192 | A | 11/2012 |
| JP | 2013-029771 | A | 2/2013 |
| JP | 2014-006292 | A | 1/2014 |
| JP | 2014-109648 | A | 6/2014 |
| JP | 2016-021050 | A | 2/2016 |

OTHER PUBLICATIONS

Extended European Search Report issued in corresponding European Patent Application No. 19756084.0, dated Nov. 27, 2020.

* cited by examiner

DEVELOPING CARTRIDGE INCLUDING BLADE AND BLADE HOLDER FOR SUPPORTING END PORTION OF BLADE

CROSS REFERENCE TO RELATED APPLICATION

This application is a continuation of U.S. patent application Ser. No. 16/458,340, filed Jul. 1, 2019, now U.S. Pat. No. 10,845,728, which claims priority from Japanese Patent Application No. 2018-183058 filed Sep. 28, 2018. The entire content of the aforementioned applications are incorporated herein by reference.

TECHNICAL FIELD

The present disclosure relates to a developing cartridge.

BACKGROUND

There has been conventionally known an electro-photographic type image forming apparatus including a frame having a photosensitive drum, and a cartridge attachable to and detachable from the frame. A conventional image forming apparatus including a cartridge is disclosed in prior art. The cartridge disclosed in the prior art includes a developing roller. During a printing process of the image forming apparatus, the developing roller is driven to rotate so that toner accommodated in the cartridge is carried on an outer circumferential surface of the developing roller. The photosensitive drum rotates in a state where the photosensitive drum contacts the developing roller, thereby transferring a toner image from the photosensitive drum onto a printing sheet.

The cartridge disclosed in the prior art includes a first frame, a second frame, the developing roller, a blade, and a support member. The first frame is assembled with the second frame by means of welding to constitute a casing in which toner is accommodatable. The developing roller is supported by the casing so as to be rotatable about a rotational axis extending in a first direction. The blade extends in the first direction and a second direction, and has a first end portion in the second direction that is positioned close to the outer circumferential surface of the developing roller. Further, the blade is configured to regulate a thickness of a toner layer carried on the outer circumferential surface of the developing roller. The support member is fixed to an outer surface of the casing by a plurality of threads to support a second end portion in the second direction of the blade.

SUMMARY

In a structure where the support member supporting the blade is fixed to the outer surface of the casing only by the plurality of threads as described in the prior art, a reinforcing rib connecting the first frame to the second frame is required in an interior of the casing in order to restrain deflection of the casing which may occur when external force is applied to the casing. However, providing the reinforcing rib may reduce an internal capacity of the casing, and also reduce a space for positioning a component such as an agitator within the casing.

In view of the foregoing, it is an object of the present disclosure to provide a developing cartridge capable of restraining deflection of a casing without the necessity of reducing the internal space of the casing.

In order to attain the above and other objects, according to one aspect, the disclosure provides a developing cartridge including: a casing; a developing roller; a blade; and a blade holder. The casing is configured to accommodate toner therein. The casing has a groove recessed inward of the casing. The developing roller is rotatable about a rotational axis extending in a first direction. The developing roller has an outer circumferential surface. The blade is configured to regulate a thickness of a layer of toner formed on the outer circumferential surface of the developing roller. The blade extends in a second direction toward the outer circumferential surface of the developing roller and having one end portion and another end portion in the second direction. The another end portion of the blade is positioned away from the one end portion of the blade in the second direction. The another end portion of the blade is positioned farther from the outer circumferential surface of the developing roller than the one end portion of the blade is from the outer circumferential surface of the developing roller. The blade holder supports the another end portion of the blade. The blade holder includes: a first plate extending in the second direction and supporting the another end portion of the blade; and a second plate extending from the first plate in a third direction crossing the second direction. The second plate has a distal end portion positioned within the groove.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

1. Image Forming Apparatus

Figure 1:
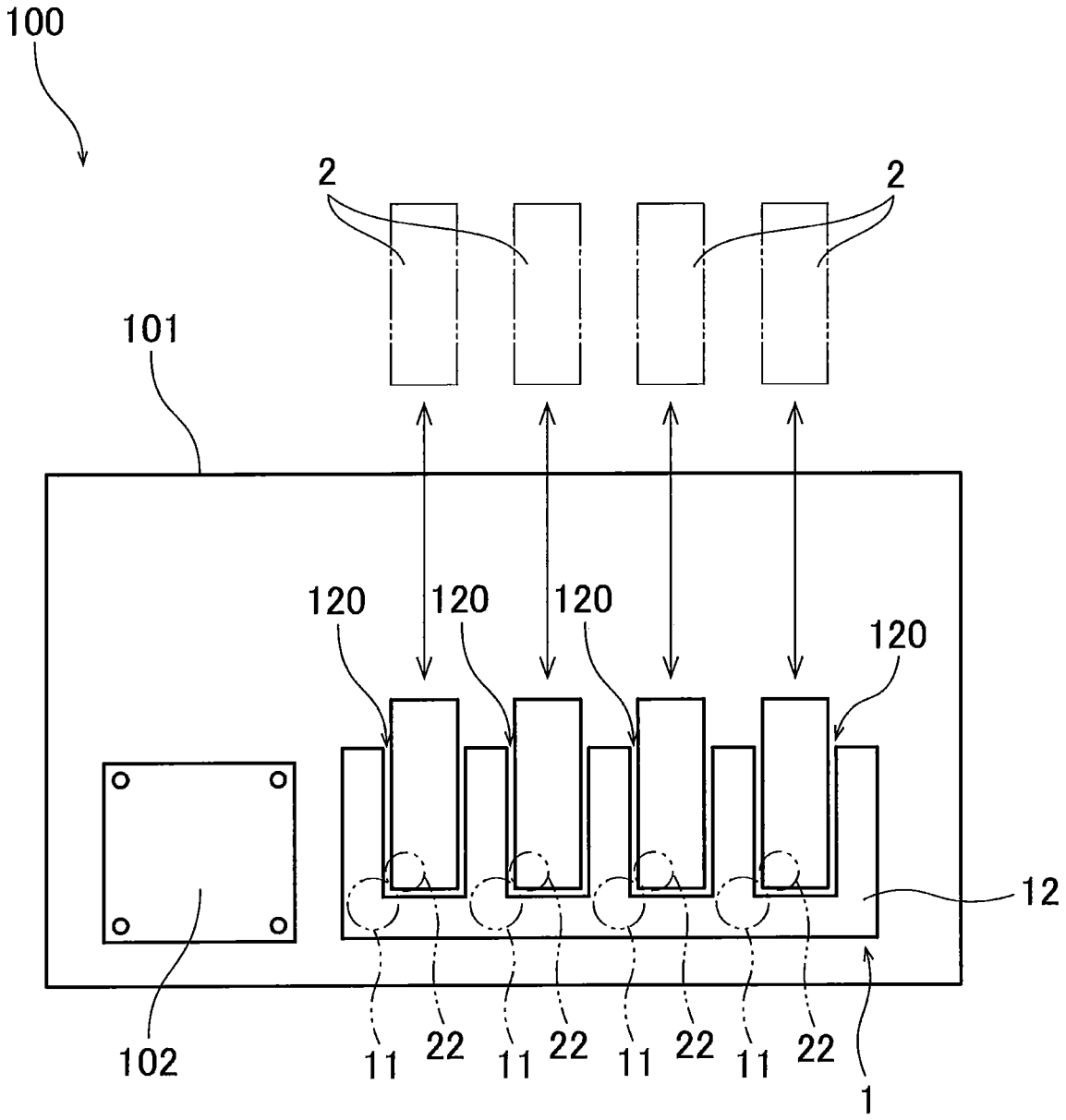
FIG. 1 is a schematic diagram of an image forming apparatus including a developing cartridge according to one embodiment of the present disclosure.

Hereinafter, an image forming apparatus 100 including developing cartridges 2 according to one embodiment of the present disclosure will be described with reference to FIGS. 1 to 5.

In the following description, in a state where the developing cartridge 2 is attached to a drum unit 1, a direction in which a rotational axis of a developing roller 22 extends will be referred to "first direction". Further, a direction in which a layer thickness regulation blade 24 extends toward an outer circumferential surface of the developing roller 22 and a direction opposite thereto will be collectively referred to as "second direction". The first direction and the second direction cross each other. Preferably, the first direction and the second direction are perpendicular to each other. A direction crossing the first direction and the second direction will be referred to as "third direction". Preferably, the third direction is perpendicular to the first direction and the second direction.

FIG. 1 is a schematic diagram of the image forming apparatus 100. The image forming apparatus 100 is an electro-photographic type printer. For example, the image forming apparatus 100 may be a laser printer or an LED printer. As illustrated in FIG. 1, the image forming apparatus 100 includes a main casing 101, a controller 102, the drum unit 1, and four developing cartridges 2. Each of the developing cartridge 2 is attachable to the drum unit 1. Further, the drum unit 1 to which four developing cartridges 2 are attached is attachable to and detachable from the main casing 101.

Four developing cartridges 2 accommodate therein developing agents (for example, toners) of colors different from one another (for example, cyan, magenta, yellow, and black). The image forming apparatus 100 is configured to form images on recording surfaces of printing sheets using toners supplied from four developing cartridges 2. Note that the number of the developing cartridges 2 attachable to the drum unit 1 may be one to three, or more than five.

The controller 102 is positioned in the main casing 101. The controller 102 is configured of, for example, a circuit board. The controller 102 includes a processor such as a CPU, and various memories. The controller 102 is configured to execute various processes in the image forming apparatus 100 by operating the processor in accordance with programs.

2. Drum Unit

The drum unit 1 illustrated in FIG. 1 includes four photosensitive drums 11 and a frame 12. Each of the photosensitive drums 11 is configured to transfer toner supplied from the corresponding one of the developing cartridges 2 to the printing sheets. The four photosensitive drums 11 are arranged to be spaced apart from one another.

Each photosensitive drum 11 has a cylindrical-shaped outer circumferential surface and extends in the first direction. The outer circumferential surface of each photosensitive drum 11 is coated with photosensitive material. Further, each photosensitive drum 11 is rotatable about a rotational axis extending in the first direction.

The frame 12 is configured to hold the four photosensitive drums 11. The frame 12 includes four cartridge-holding portions 120. The four cartridge-holding portions 120 are arrayed with each other with an interval between neighboring cartridge-holding portions 120. Each of the cartridge-holding portions 120 is configured to receive the corresponding one of the developing cartridges 2.

3. Developing Cartridges

Figure 2:
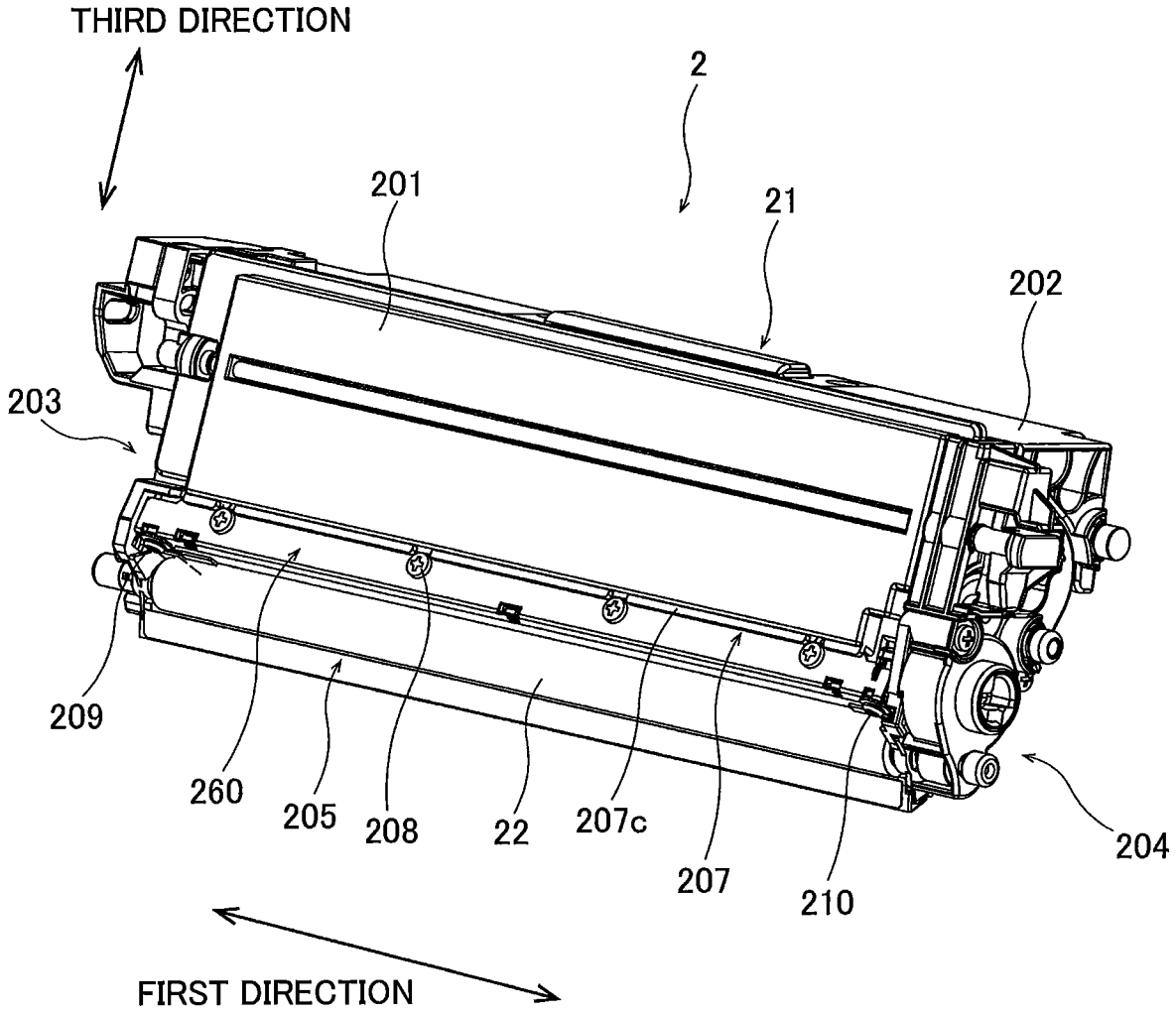
FIG. 2 is a perspective view of the developing cartridge according to the embodiment.
Figure 3:
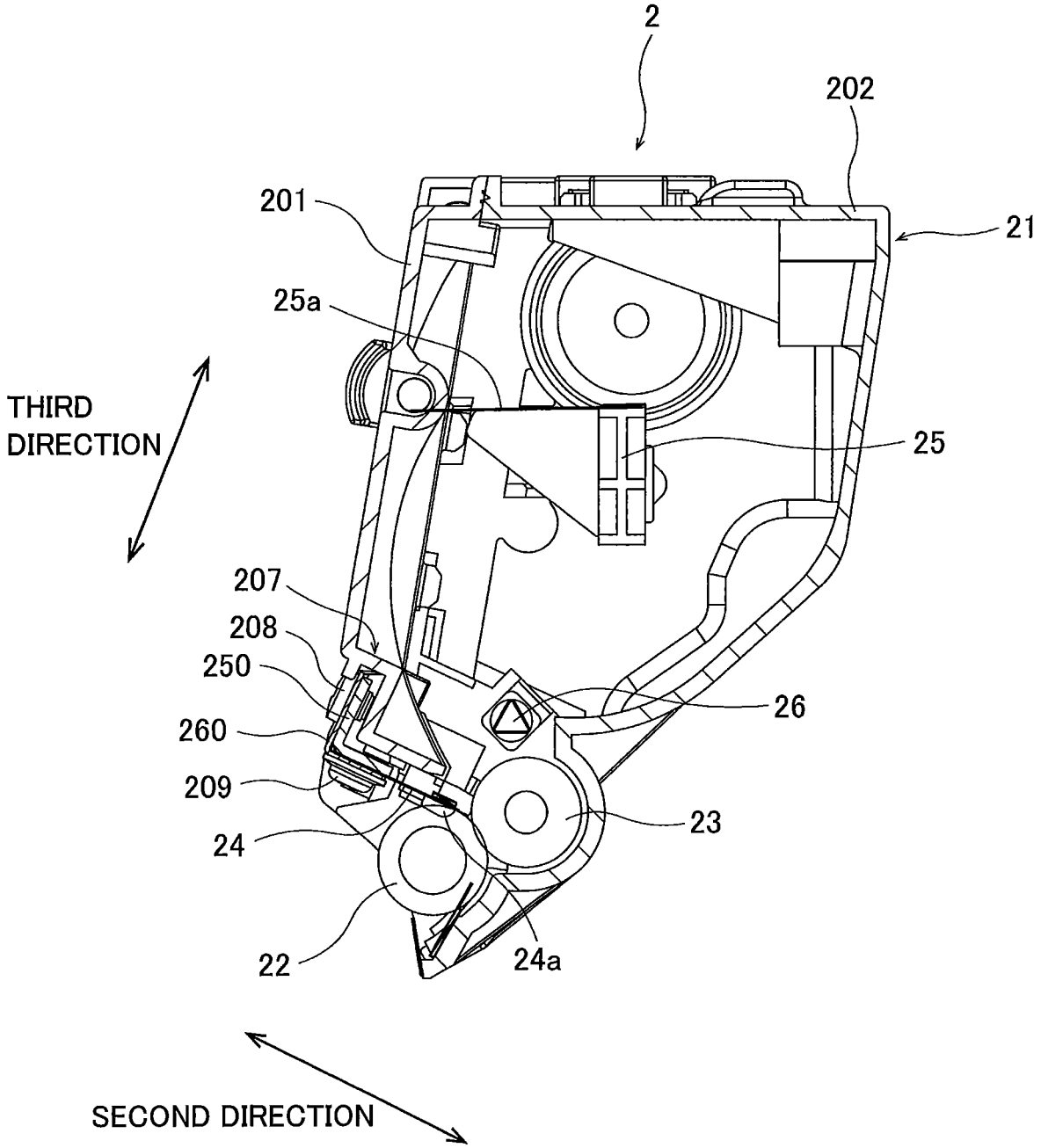
FIG. 3 is a cross-sectional view of the developing cartridge according to the embodiment taken along a plane perpendicular to a first direction.
Figure 4:
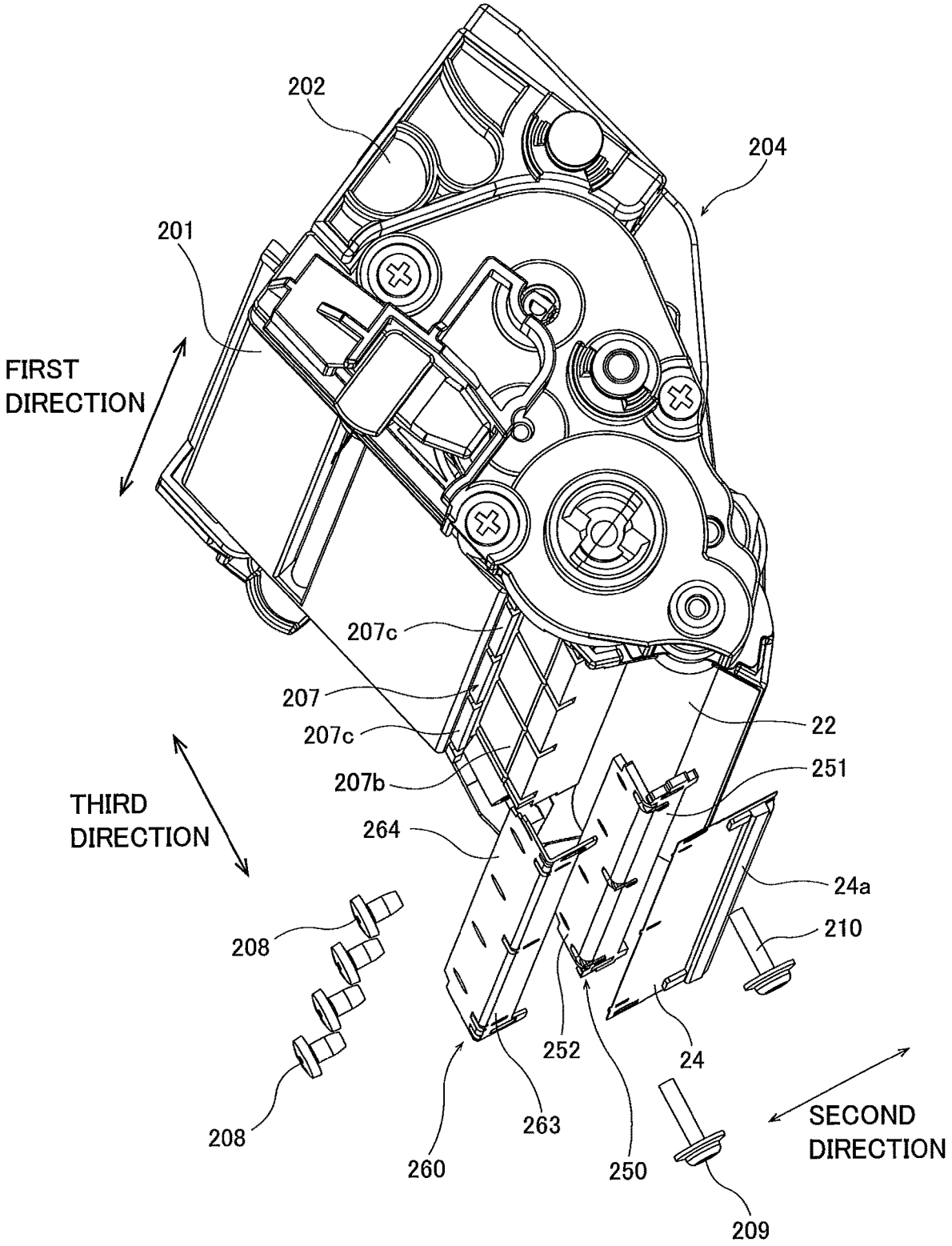
FIG. 4 is a perspective view of the developing cartridge according to the embodiment in which a portion of the developing cartridge is exploded.
Figure 5:
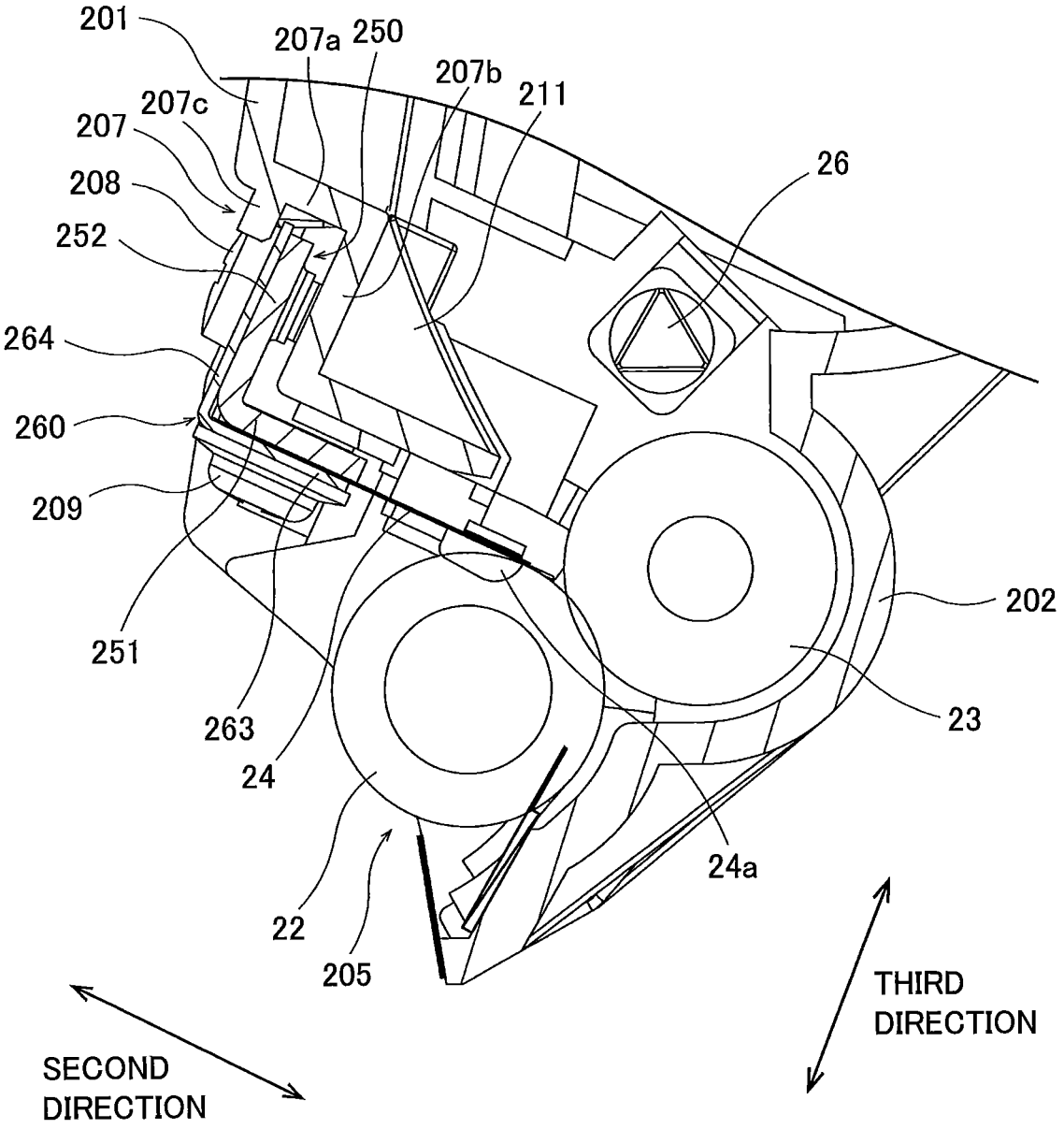
FIG. 5 is an enlarged view of a portion of the developing cartridge according to the embodiment illustrated in FIG. 3.

FIG. 2 is a perspective view of the developing cartridge 2. FIG. 3 is a cross-sectional view of the developing cartridge 2 as viewed in the first direction. FIG. 4 is a perspective view of the developing cartridge 2 in which a portion of the developing cartridge 2 is exploded. FIG. 5 is an enlarged view of a portion of the developing cartridge 2 illustrated in FIG. 3. As illustrated in FIGS. 2 through 5, each of the developing cartridges 2 includes a casing 21, the developing roller 22, a supply roller 23, the layer thickness regulation blade 24 as an example of a blade, a first agitator 25, and a second agitator 26.

The casing 21 is a container configured to accommodate toner therein. The casing 21 is made of resin. The casing 21 is configured of a first frame 201 and a second frame 202. As illustrated in FIGS. 2 through 4, the first frame 201 has a lid-like shape. The second frame 202 has a box shape and faces the first frame 201 in the second direction. By assembling the second frame 202 with the first frame 201, the casing 21 is configured as a container. The casing 21 has one end portion 203 in the first direction, and another end portion 204 spaced apart from the one end portion 203 in the first direction. Further, the first frame 201 has an opening 205 at one end portion thereof in the third direction. Detailed configuration of the first frame 201 will be described later.

The developing roller 22 is rotatable about its rotational axis extending in the first direction. The developing roller 22 has one end portion in the first direction supported by the one end portion 203, and another end portion in the first direction supported by the other end portion 204. The developing roller 22 is positioned at the opening 205 of the casing 21. Hence, a portion of the outer circumferential surface of the developing roller 22 is exposed to an outside of the casing 21. Upon attachment of each developing cartridge 2 to the corresponding cartridge-holding portion 120 of the drum unit 1, an outer circumferential surface of the photosensitive drum 11 and the outer circumferential surface of the corresponding developing roller 22 are in contact with each other.

The supply roller 23 illustrated in FIGS. 3 and 5 is rotatable about a rotational axis extending in the first direction. The supply roller 23 has one end portion in the first direction supported by the one end portion 203, and another end portion in the first direction supported by the other end portion 204. The supply roller 23 is positioned between the first agitator 25 and the developing roller 22 in the third direction. The supply roller 23 is positioned adjacent to the developing roller 22. A portion of the supply roller 23 having an outer circumferential surface of the supply roller 23 is made from, for example, a rubber having elasticity. The outer circumferential surface of the supply roller 23 and the outer circumferential surface of the developing roller 22 are in contact with each other. Hence, toner can be supplied from the supply roller 23 to the outer circumferential surface of the developing roller 22.

The layer thickness regulation blade 24 is configured to regulate thickness of a layer of toner formed on the outer circumferential surface of the developing roller 22 so that the thickness of the layer of toner is formed to a constant thickness. The layer thickness regulation blade 24 extends in the second direction toward the outer circumferential surface of the developing roller 22. The layer thickness regulation blade 24 is positioned between the one end portion 203 and the other end portion 204 of the casing 21 in the first direction. The layer thickness regulation blade 24 is positioned opposite to the supply roller 23 with respect to the developing roller 22 in the second direction.

The layer thickness regulation blade 24 has one end portion in the second direction positioned adjacent to the developing roller 22 and in contact with the outer circumferential surface of the developing roller 22. Further, the layer thickness regulation blade 24 has another end portion in the second direction positioned away from the one end portion of the layer thickness regulation blade 24. The other end portion of the layer thickness regulation blade 24 is positioned farther from the outer circumferential surface of the developing roller 22 than the one end portion of the layer thickness regulation blade 24 is from the outer circumferential surface of the developing roller 22. An acting portion 24*a* made from rubber is provided at the one end portion in the second direction of the layer thickness regulation blade 24. The contact of the acting portion 24*a* with the toner layer on the outer circumferential surface of the developing roller 22 regulates the thickness of the toner layer. A portion of the layer thickness regulation blade 24 other than the acting portion 24*a* is formed of a metal plate.

The other end portion in the second direction of the layer thickness regulation blade 24 is supported by the first frame 201 of the casing 21 through the first blade holder 250 and a second blade holder 260 (described later). A detailed configuration for supporting the other end portion of the layer thickness regulation blade 24 will be described later.

The first agitator 25 illustrated in FIG. 3 is configured to agitate toner accommodated in an internal space of the casing 21. The first agitator 25 is rotatable about a rotational axis extending in the first direction. The first agitator 25 includes a blade 25*a* in a form of a film. The blade 25*a* has a distal end portion in contact with an inner surface of the casing 21. The rotation of the first agitator 25 about its rotational axis causes the blade 25*a* to rotate. Upon rotation of the blade 25*a*, the toner accommodated in the casing 21 is agitated.

The second agitator 26 is also configured to agitate the toner accommodated in the internal space of the casing 21. Specifically, the second agitator 26 is configured to mainly agitate toner positioned in a region in the internal space in which toner is not sufficiently agitated by the first agitator 25. The second agitator 26 is positioned between the supply roller 23 and the first agitator 25 in the third direction. The second agitator 26 is rotatable about its rotational axis extending in the first direction. The second agitator 26 is positioned closer to the supply roller 23 than to the developing roller 22 in the third direction. With this configuration, toner agitated by the second agitator 26 can be efficiently supplied to the supply roller 23.

In the image forming apparatus 100 configured as described above, the outer circumferential surface of the photosensitive drum 11 is exposed to laser beam after the outer circumferential surface is uniformly charged, so that an electrostatic latent image is formed on the outer circumferential surface of the photosensitive drum 11 on a basis of inputted print data. Toner accommodated in the casing 21 is supplied to the supply roller 23 while the toner is agitated by the first agitator 25 and the second agitator 26, and is then supplied to the developing roller 22 from the supply roller 23. More specifically, toner is entered into a portion between the developing roller 22 and the layer thickness regulation blade 24 in accordance with the rotation of the developing roller 22, and the toner is carried on the outer circumferential surface of the developing roller 22 as the thin toner layer having constant thickness.

The toner carried on the outer circumferential surface of the developing roller 22 is supplied to the electrostatic latent image formed on the outer circumferential surface of the photosensitive drum 11, thereby causing the electrostatic latent image to become a visible image to form a toner image on the outer circumferential surface of the photosensitive drum 11. The formed toner image is transferred to the recording surface of the printing sheet and is then thermally fixed thereto, whereupon the printing process is terminated.

4. Structure for Supporting Layer Thickness Regulation Blade

A structure for supporting the layer thickness regulation blade 24 will be described while mainly referring to FIGS. 4 and 5. The layer thickness regulation blade 24 is attached to and supported by the first frame 201 of the casing 21 using the support structure according to the embodiment. Specifically, the support structure is configured by the first blade holder 250, the second blade holder 260, a plurality of grooves 207, a first thread 209 as an example of a first fastening member, a second thread 210 as an example of second fastening member, and a plurality of third threads 208.

The first blade holder 250 illustrated in FIGS. 3 to 5 is configured to support the other end portion in the second direction of the layer thickness regulation blade 24. The first blade holder 250 is made of metal. Although it is preferable that the metal contains iron, the first blade holder 250 may be made from stainless steel. The first blade holder 250 includes a first plate 251 and a second plate 252. The first plate 251 has a flat plate shape that extends in the first direction and the second direction. The first plate 251 has one end portion in the second direction closer to the developing roller 22 than another end portion in the second direction of the first plate 251 is to the developing roller 22. The first plate 251 has a pair of opposing surfaces crossing the third direction. One of the opposing surfaces that faces a third plate 263 (described later) of the second blade holder 260 is in contact with the layer thickness regulation blade 24.

The second plate 252 extends in the third direction from the other end portion in the second direction of the first plate 251. The second plate 252 extends perpendicularly to the first plate 251 in the present embodiment. The second plate 252 has a flat plate shape extending in the first direction and the third direction. The second plate 252 has a base end portion connected to the other end portion in the second direction of the first plate 251, and a distal end portion extending toward the plurality of grooves 207.

The second blade holder 260 is configured to support the other end portion of the layer thickness regulation blade 24 in cooperation with the first blade holder 250. The second blade holder 260 is made from metal preferably containing iron. However, the second blade holder 260 may be made from stainless steel. The second blade holder 260 includes the third plate 263 and a fourth plate 264. The third plate 263 has a flat plate shape extending in the first direction and the second direction. The third plate 263 has one end portion in the second direction closer to the developing roller 22 than another end portion in the second direction of the third plate 263 is to the developing roller 22. The third plate 263 has a pair of opposing surfaces crossing the third direction. One of the opposing surfaces facing the first plate 251 is in contact with the layer thickness regulation blade 24. That is, the layer thickness regulation blade 24 is nipped between the first plate 251 and the third plate 263 to be supported thereby in the present embodiment.

The fourth plate 264 extends in the third direction from the other end portion in the second direction of the third plate 263. In the present embodiment, the fourth plate 264 extends perpendicularly relative to the third plate 263. The fourth plate 264 has a flat plate shape extending in the first direction and the third direction. The fourth plate 264 has a base end portion connected to the other end portion in the second direction of the third plate 263, and a distal end portion extending toward the grooves 207.

Each of the plurality of grooves 207 is provided at the first frame 201 of the casing 21. Each groove 207 extends in the first direction and is recessed inward of the casing 21 in the third direction. In the present embodiment, the grooves 207 extend from the one end portion 203 to the other end portion 204 in the first direction. As illustrated in FIGS. 4 and 5, the first frame 201 includes a groove bottom wall 207*a*, an inner wall 207*b*, and a plurality of outer walls 207*c* those constituting the grooves 207.

The groove bottom wall 207*a* is a plate like portion extending in the first direction, and has a constant width (groove width) in the second direction. The groove bottom wall 207*a* has the groove width greater than a total of thicknesses of the second plate 252 and the fourth plate 264. In the present embodiment, the groove bottom wall 207*a* extends in the first direction over the one end portion 203 and the other end portion 204.

The inner wall 207*b* is a plate like portion that extends in the first direction and the third direction. Specifically, the inner wall 207*b* extends in the first direction over the one end portion 203 and the other end portion 204. The inner wall 207*b* extends in the third direction from one end in the second direction of the groove bottom wall 207*a* toward the first plate 251. The first frame 201 includes a rib 211 positioned on an inner surface of the inner wall 207*b*. The inner wall 207*b* is supported and reinforced by the rib 211.

Each of the plurality of outer walls 207*c* extends in the first direction and the third direction. As illustrated in FIG. 4, the plurality of outer walls 207*c* are arrayed in the first direction with a prescribed interval between neighboring outer walls 207*c*. That is, the plurality of grooves 207 are arrayed in the first direction with an interval between neighboring grooves 207. Each of the outer walls 207*c* extends toward an outside of the casing 21 in the third direction from another end in the second direction of the groove bottom wall 207*a*. That is, the inner wall 207*b* and the outer walls 207*c* face each other in the second direction with a gap corresponding to the groove width of the groove bottom wall 207*a* therebetween.

The first thread 209, the second thread 210, and the plurality of third threads 208 are fastening members for fixing the first blade holder 250 and the second blade holder 260 to the first frame 201. The Number of the plurality of third threads 208 is smaller than the number of the plurality of outer walls 207*c* by one. Each of the second plate 252 and the fourth plate 264 has a plurality of through-holes allowing the corresponding third threads 208 to be inserted therethrough. Further, the inner wall 207*b* has a plurality of threaded holes with which the corresponding third threads 208 threadingly engage.

Each of the first plate 251 and the third plate 263 has one end portion in the first direction having through-holes allowing the first thread 209 to be inserted therethrough, and another end portion in the first direction having through-holes allowing the second thread 210 to be inserted therethrough. Further, one end portion in the first direction of the first frame 201 has a threaded hole with which the first thread 209 threadingly engages, and another end portion in the first direction of the first frame 201 has a threaded hole with which the second thread 210 threadingly engages.

With this support structure, the other end portion in the second direction of the layer thickness regulation blade 24 is nipped between the first plate 251 and the third plate 263. In this state, the second plate 252 and the fourth plate 264 are overlapped with each other, and distal end portions of the second plate 252 and the fourth plate 264 are positioned within the grooves 207. In this case, each of the through-holes of the second plate 252 is overlapped with the corresponding one of the through-holes of the fourth plate 264 and the corresponding one of the intervals formed between neighboring outer walls 207*c*. Each of the third threads 208 is inserted into the overlapped through-holes and the interval, and threadingly engages with the corresponding threaded hole formed in the inner wall 207*b*.

Further, the through-hole formed in the one end portion in the first direction of the first plate 251 and the through-hole formed in the one end portion in the first direction of the third plate 263 are overlapped with each other. The first thread 209 is inserted into the overlapped through-holes, and threadingly engages with the threaded hole formed in the one end portion in the first direction of the first frame 201.

Similarly, the through-hole formed in the other end portion in the first direction of the first plate 251 and the through-hole formed in the other end portion in the first direction of the third plate 263 are overlapped with each other. The second thread 210 is inserted through the overlapped through-holes, and threadingly engages with the threaded hole formed in the other end portion in the first direction of the first frame 201.

In this way, the layer thickness regulation blade 24 is attached to and supported by the first frame 201 of the casing 21. In this case, the distal end portion of the second plate 252 of the first blade holder 250 and the distal end portion of the fourth plate 264 of the second blade holder 260 are positioned within the grooves 207 of the first frame 201. With this configuration, the first frame 201 can be reinforced with the second plate 252 and the fourth plate 264. Accordingly, deflection and deformation of the casing 21 can be restrained even if an external force that may reduce the internal space of the casing 21 in the second direction is applied to the casing 21, thereby restraining leakage of toner accommodated in the casing 21 in spite of the application of the external force to the casing 21.

Further, the first blade holder 250 and the second blade holder 260 function not only to reinforce the casing 21 but also to hold the layer thickness regulation blade 24. Therefore, the numbers of parts and components in the developing cartridge 2 can be reduced.

Further, as illustrated in FIG. 5, the distal end portions of the second plate 252 and the fourth plate 264 are positioned within the grooves 207 such that gaps in the second direction are positioned between the second plate 252 and the inner wall 207*b*, and between the fourth plate 264 and the outer walls 207*c*. Therefore, even if the casing 21 is deflected or deformed due to the application of the external force that reduces the internal space of the casing 21 in the second direction, the deflected casing 21 (the deflected first frame 201) is brought into abutment against the second plate 252 of the first blade holder 250 and the fourth plate 264 of the second blade holder 260, thereby restraining further deflection or deformation of the casing 21. Hence, excessive deflection or deformation of the casing 21 does not occur. As a result, leakage of toner from the internal space of the casing 21 can be suppressed in spite of the application of the external force to the casing 21.

Further, the plurality of grooves 207 are positioned at a position between the one end portion 203 and the other end portion 204 of the casing 21 in the first direction. In other words, the grooves 207 are positioned at least at an intermediate portion between the one end portion 203 and the other end portion 204, where deflection more likely to occur among an entire region of the casing 21 in the first direction. Since the distal end portion of the second plate 252 of the first blade holder 250 and the distal end portion of the fourth plate 264 of the second blade holder 260 are positioned within these grooves 207, deflection or deformation of the casing 21 can be restrained well.

Further, because the first blade holder 250 and the second blade holder 260 are made of metal, the casing 21 can be firmly reinforced with the metallic first blade holder 250 and the second blade holder 260. Therefore, deflection or deformation of the casing 21 can be desirably restrained. Further, the casing 21 itself may have insufficient rigidity, since the casing 21 is made of resin. However, reinforcement of the casing 21 by the metallic first blade holder 250 and the second blade holder 260 can enhance rigidity of the casing 21.

Further, in the developing cartridge 2 according to the above-described embodiment, the third threads 208 are arrayed in the first direction with prescribed gap therebetween such that each third thread 208 is positioned at the corresponding interval between neighboring outer walls 207*c* in the first direction. Therefore, at least a portion of each third thread 208 is positioned between the corresponding interval between neighboring grooves 207 in the first direction. Thus, the first blade holder 250 and the second blade holder 260 can be stably attached to the casing 21.

Further, as illustrated in FIG. 2, each third thread 208 has a head portion positioned in the corresponding interval formed between neighboring outer walls 207*c* in the first direction. Thus, the head portion of each third thread 208 is exposed to an outside of the grooves 207. Hence, a shaft portion of each third thread 208 can be inserted into the through-holes of the second plate 252 and the fourth plate 264, so that a tip end portion of the shaft portion of each third thread 208 can threadingly engages with the threaded hole of the inner wall 207*b*.

Further, in the developing cartridge 2 according to the above-described embodiment, the other end portion in the second direction of the layer thickness regulation blade 24 is supported by nipping the other end portion between the first plate 251 of the first blade holder 250 and the third plate 263 of the second blade holder 260. This configuration can more stably support the layer thickness regulation blade 24.

Further, in the developing cartridge 2 according to the above-described embodiment, the first plate 251 and the third plate 263 are fastened to the casing 21 by the first thread 209 and the second thread 210. Accordingly, the layer thickness regulation blade 24 nipped between the first plate 251 and the third plate 263 can be stably supported by the casing 21. Further, in a case where the image forming apparatus 100 is a laser printer, the first thread 209 and the second thread 210 do not interfere with laser beam emitted toward the outer circumferential surface of the photosensitive drum 11, since the first thread 209 and the second thread 210 are positioned at end portions in the first direction of the first blade holder 250 and the second blade holder 260.

Further, in the developing cartridge 2 according to the above-described embodiment, a conventional structure for restraining deflection or deformation of the second frame toward the first frame, such as a rib disposed in the internal space of the casing and connecting an inner surface of the first frame to an inner surface of the second frame, is not provided. Hence, reduction in internal capacity of the casing 21 can be avoided while restraining deflection or deformation of the casing 21. Consequently, the second agitator 26 can be positioned closer to the supply roller 23 than to the developing roller 22. Since the second agitator 26 can be provided at a position adjacent to the supply roller 23, sufficiently agitated toner can be continuously supplied from the supply roller 23 to the developing roller 22.

5. Modifications

While the description has been made in detail with reference to the specific embodiment, it would be apparent to those skilled in the art that many modifications and variations may be made thereto. Various modifications to the above embodiment will be briefly described below.

For example, the second plate 252 of the first blade holder 250 extends perpendicularly to the first plate 251 in the above-described embodiment. That is, an angle defined between the first plate 251 and the second plate 252 is right angle. However, the angle between the first plate 251 and the second plate 252 may be acute angle or obtuse angle. Similarly, in the second blade holder 260 of the above-described embodiment, the fourth plate 264 extends perpendicularly to the third plate 263. However, an angle defined between the third plate 263 and the fourth plate 264 may be acute angle or obtuse angle.

In the above-described embodiment, the other end portion in the second direction of the layer thickness regulation blade 24 is supported by both the first blade holder 250 and the second blade holder 260. However, one of the first blade holder 250 and the second blade holder 260 may be dispensed with. In this case, the other end portion in the second direction of the layer thickness regulation blade 24 may be attached to the first plate 251 of the first blade holder 250 or the third plate 263 of the second blade holder 260 by welding means such as spot welding.

In the above-described embodiment, the grooves 207 are provided substantially over the entire region between the one end portion 203 and the other end portion 204 of the first frame 201. However, the grooves 207 may be positioned only at a center portion in the first direction of the first frame 201 instead. Here, among the entire region of the casing 21 in the first direction, deflection most likely occurs at the center portion of the casing 21 in the first direction. In this case, since the grooves 207 is positioned at the center portion of the casing 21 in the first direction and the distal end portions of the second plate 252 of the first blade holder 250 and the fourth plate 264 of the second blade holder 260 are positioned inside the grooves 207, deflection of the casing 21 can be efficiently restricted. Further, by forming the grooves 207 only at the center portion in the first direction of the casing 21, a region at which the grooves 207 is positioned can be reduced, thereby causing material cost and machining cost to be reduced.

The first blade holder 250 and the second blade holder 260 may be formed of a material other than metal. In the latter case, sufficient rigidity of the first blade holder 250 and the second blade holder 260 may be obtained by increasing thickness thereof.

The second agitator 26 may be dispensed with.

Further, the detailed configuration of the image forming apparatus and the developing cartridge may be suitably modified without departing from the scope of the present disclosure. Further, various features appearing in the above embodiment and the above modifications may be suitably combined together avoiding conflicting combination.

What is claimed is:

1. A developing cartridge comprising:

a casing configured to accommodate toner therein, the casing having a groove recessed inward of the casing, the casing including an inner wall constituting the groove;

a developing roller rotatable about a rotational axis extending in a first direction, the developing roller having an outer circumferential surface;

a blade configured to regulate a thickness of a layer of toner formed on the outer circumferential surface of the developing roller, the blade extending in a second direction toward the outer circumferential surface of the developing roller and having one end portion and another end portion in the second direction, the another end portion of the blade being positioned away from the one end portion of the blade in the second direction, the another end portion of the blade being positioned farther from the outer circumferential surface of the developing roller than the one end portion of the blade is from the outer circumferential surface of the developing roller; and a blade holder supporting the another end portion of the blade, the blade holder including:

a first plate extending in the second direction and supporting the another end portion of the blade; and a second plate extending from the first plate in a third direction crossing the second direction, the second plate having a base end portion connected to the first plate, the second plate having a distal end portion positioined away from the base end portion in the third direction, the distal end portion being positioned within the groove, the distal end portion being positioned closer to the inner wall than the base end portion is to the inner wall.

2. The developing cartridge according to claim 1, wherein the distal end portion of the second plate is positioned within the groove with a gap between the distal end portion of the second plate and the inner wall.

3. The developing cartridge according to claim 2, wherein the distal end portion of the second plate is positioned within the groove with the gap between the distal end portion of the second plate and the inner wall in the second direction.

4. The developing cartridge according to claim 1, wherein the casing has one end portion and another end portion in the first direction, the another end portion of the casing being spaced apart from the one end portion of the casing in the first direction, and wherein the groove is positioned at the casing at a position between the one end portion and the another end portion of the casing.

5. The developing cartridge according to claim 4, wherein the groove is positioned at the casing at a center portion of the casing between the one end portion and the another end portion of the casing.

6. The developing cartridge according to claim 1, wherein the blade holder is made of metal.

7. The developing cartridge according to claim 6, wherein the blade holder is made of metal containing iron.

8. The developing cartridge according to claim 6, wherein the blade holder is made of stainless steel.

9. The developing cartridge according to claim 1, wherein the casing is made of resin.

10. The developing cartridge according to claim 1, further comprising a thread fixing the second plate to the casing.

11. The developing cartridge according to claim 10, further comprising another thread fixing the second plate to the casing, the thread and the another thread being arrayed in the first direction with a prescribed interval therebetween.

12. A developing cartridge comprising:

a casing configured to accommodate toner therein, the casing having a groove recessed inward of the casing;

a developing roller rotatable about a rotational axis extending in a first direction, the developing roller having an outer circumferential surface;

a blade configured to regulate a thickness of a layer of toner formed on the outer circumferential surface of the developing roller, the blade extending in a second direction toward the outer circumferential surface of the developing roller and having one end portion and another end portion in the second direction, the another end portion of the blade being positioned away from the one end portion of the blade in the second direction, the another end portion of the blade being positioned farther from the outer circumferential surface of the developing roller than the one end portion of the blade is from the outer circumferential surface of the developing roller;

a blade holder supporting the another end portion of the blade, the blade holder including:

a first plate extending in the second direction and supporting the another end portion of the blade; and a second plate extending from the first plate in a third direction crossing the second direction, the second plate having a distal end portion positioned within the groove; and a second blade holder supporting the another end portion of the blade, the second blade holder including:

a third plate extending in the second direction and supporting the another end portion of the blade; and a fourth plate extending from the third plate in the third direction, wherein the another end portion of the blade is nipped between the first plate and the third plate.

13. The developing cartridge according to claim 12, wherein each of the first plate and the third plate has one end portion and another end portion in the first direction, the developing cartridge further comprising:

a first fastening member fastening the one end portion of the first plate and the one end portion of the third plate to the casing; and a second fastening member fastening the another end portion of the first plate and the another end portion of the third plate to the casing.

14. A developing cartridge comprising:

a casing configured to accommodate toner therein, the casing having a groove recessed inward of the casing;

a developing roller rotatable about a rotational axis extending in a first direction, the developing roller having an outer circumferential surface;

a blade configured to regulate a thickness of a layer of toner formed on the outer circumferential surface of the developing roller, the blade extending in a second direction toward the outer circumferential surface of the developing roller and having one end portion and another end portion in the second direction, the another end portion of the blade being positioned away from the one end portion of the blade in the second direction, the another end portion of the blade being positioned farther from the outer circumferential surface of the developing roller than the one end portion of the blade is from the outer circumferential surface of the developing roller; and a blade holder supporting the another end portion of the blade, the blade holder including:

a first plate extending in the second direction and supporting the another end portion of the blade; and a second plate extending from the first plate in a third direction crossing the second direction, the second plate having a distal end portion positioned within the groove, wherein the casing includes:

a first frame having the groove; and a second frame facing the first frame in the second direction, the second frame being assembled with the first frame to constitute the casing.

15. The developing cartridge according to claim 14, further comprising:

a first agitator rotatable about a rotational axis extending in the first direction and configured to agitate toner accommodated in the casing; and a supply roller positioned between the first agitator and the developing roller and positioned opposite to the blade holder with respect to the developing roller in the second direction, the supply roller being rotatable about a rotational axis extending in the first direction and configured to supply the toner accommodated in the casing to the outer circumferential surface of the developing roller.

16. The developing cartridge according to claim 15, further comprising a second agitator positioned between the supply roller and the first agitator, the second agitator being rotatable about a rotational axis extending in the first direction.

17. The developing cartridge according to claim 16, wherein the second agitator is positioned closer to the supply roller than to the developing roller.

* * * * *